US008668790B2

(12) United States Patent
Yang et al.

(10) Patent No.: US 8,668,790 B2
(45) **Date of Patent: *Mar. 11, 2014**

(54) HEAT TREATMENT METHOD AND COMPONENTS TREATED ACCORDING TO THE METHOD

(75) Inventors: Ling Yang, Clifton Park, NY (US); Jeffrey Allen Hawk, Guilderland, NY (US); Robin Carl Schwant, Pattersonville, NY (US)

(73) Assignee: General Electric Company, Schenectady, NY (US)

( * ) Notice: Subject to any disclaimer, the term of this patent is extended or adjusted under 35 U.S.C. 154(b) by 1032 days.

This patent is subject to a terminal disclaimer.

(21) Appl. No.: 11/620,884

(22) Filed: Jan. 8, 2007

(65) Prior Publication Data

US 2010/0276041 A1 Nov. 4, 2010

(51) Int. Cl.
*C22F 1/10* (2006.01)
*C21D 6/02* (2006.01)

(52) U.S. Cl.
USPC ..... 148/675; 148/674; 148/579

(58) Field of Classification Search
USPC ..... 148/675, 674, 579
See application file for complete search history.

(56) References Cited

U.S. PATENT DOCUMENTS

| | | | | |
|---|---|---|---|---|
| 2,327,839 | A | 8/1943 | Zschokke | |
| 3,220,829 | A | 11/1965 | Stewart et al. | |
| 3,420,660 | A * | 1/1969 | Katoh et al. | 148/326 |
| 3,705,827 | A | 12/1972 | Muzyka | |
| 3,826,649 | A * | 7/1974 | Helmer et al. | 420/47 |
| 3,871,928 | A | 3/1975 | Smith, Jr. et al. | |
| 4,608,094 | A | 8/1986 | Miller et al. | |
| 4,788,036 | A | 11/1988 | Eiselstein et al. | |
| 4,985,201 | A | 1/1991 | Chang et al. | |
| 5,019,334 | A | 5/1991 | Jackson | |
| 5,080,734 | A | 1/1992 | Krueger et al. | |
| 5,100,050 | A | 3/1992 | Krueger et al. | |
| 5,161,950 | A | 11/1992 | Krueger et al. | |
| 5,374,323 | A | 12/1994 | Kuhlman et al. | |
| 5,415,712 | A | 5/1995 | Thamboo | |
| 5,820,817 | A | 10/1998 | Angeliu et al. | |
| 5,846,353 | A | 12/1998 | Nazmy et al. | |
| 5,863,494 | A | 1/1999 | Nazmy et al. | |
| 6,128,820 | A | 10/2000 | Nolan et al. | |
| 6,146,478 | A * | 11/2000 | Balbach et al. | 148/707 |
| 6,217,286 | B1 | 4/2001 | Huang et al. | |
| 6,315,846 | B1 * | 11/2001 | Hibner et al. | 148/675 |
| 6,447,624 | B2 | 9/2002 | Nonomura et al. | |
| 6,454,531 | B1 | 9/2002 | Crawmer | |
| 6,494,683 | B1 | 12/2002 | Nolan et al. | |
| 7,033,448 | B2 | 4/2006 | Groh et al. | |

OTHER PUBLICATIONS

Karl A. Heck, "The Time-Temperature-Transformation Behavior of Alloy 706", The Minerals, Metals & Materials Society, 1994, pp. 393-404.

Sarwan Mannan and Frank Veltry, "Time-Temperature-Transformation Diagram of Alloy 725", The Minerals, Metals & Materials Society, 2001, pp. 345-350.

ASM International, Materials Park, Ohio, ASM Specialty Handbook: Nickel, Cobalt, and Their Alloys, "Metallography and Microstructures of Heat Resistant Alloys", Dec. 2000, pp. 302-304.

* cited by examiner

*Primary Examiner* — Jessee Roe
(74) *Attorney, Agent, or Firm* — Cantor Colburn LLP

(57) ABSTRACT

Disclosed herein is a method of treating a component comprising solution treating the component for a period of about 4 to about 10 hours at a temperature of about 1750 to about 1850° F.; cooling the component to a temperature of about 1490 to about 1520° F. at an average rate of 1° F./min to about 25° F./min; stabilizing the component at about 1450 to about 1520° F. for a period of from about 1 to about 10 hours; cooling the component to room temperature; precipitation aging the component by heating the component to a first precipitation aging temperature of about 1275 to about 1375° F. for about 3 to about 15 hours; cooling the component at an average rate of 50 to about 150° F./hour to a second precipitation aging temperature of about 1100 to about 1200° F. for a time period of about 2 to about 15 hours; and cooling the component.

13 Claims, 1 Drawing Sheet

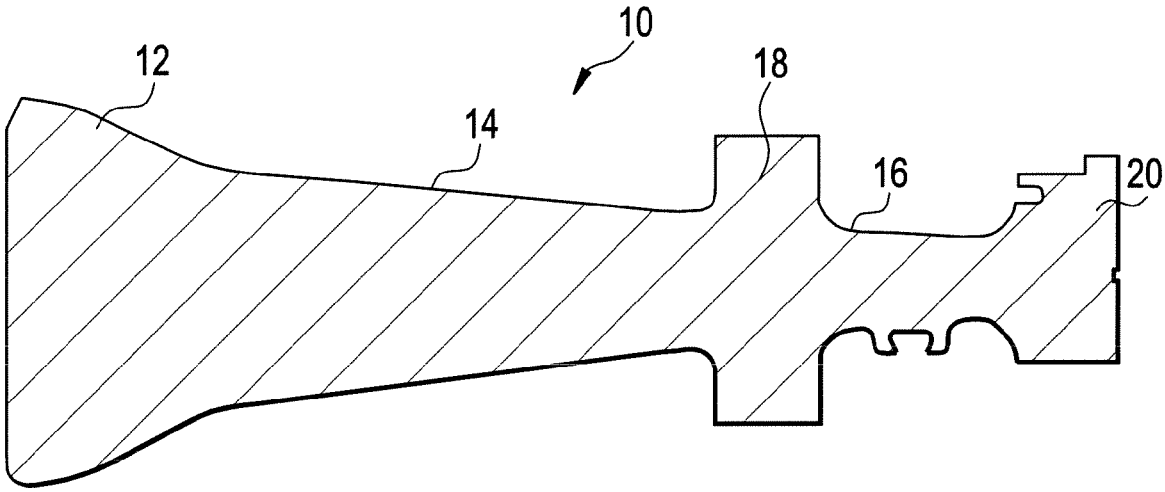
10
12
14
18
16
20

HEAT TREATMENT METHOD AND COMPONENTS TREATED ACCORDING TO THE METHOD

BACKGROUND OF THE INVENTION

This disclosure is related to a heat treatment method and to components heat treated according to the method.

Superalloys are metallic alloys for elevated temperature service, generally based on group VIIA elements of the periodic table, and are used for elevated temperature applications where resistance to deformation and stability are desired. The common superalloys are based on nickel, cobalt or iron. Nickel-iron base superalloys such as, for example Alloy 706 are generally employed as materials of construction in gas turbine engine components such as rotor discs (hereinafter rotors) and spacers.

Nickel-iron base superalloys such as Alloy 706 are generally employed as materials of construction in gas turbine engine components such as rotor discs (hereinafter rotors) and spacers. As a result of the demand for improved performance and efficiency, the components of modern gas turbine engines operate near the limit of their properties with respect to temperature, stress, and oxidation/corrosion. Due to these aggressive operating environments, the superalloy materials from which the components are made must possess a combination of exceptional properties including high strength capabilities at elevated temperatures and rotational speeds. In particular, it is desirable for nickel-iron base superalloy articles suitable for components such as turbine rotors and discs to possess resistance to crack growth.

There are two known heat treatment processes that are prescribed by International Nickel Company (INCO), the inventor of the Alloy 706. The two known heat treatment processes are heat treatment A and heat treatment B respectively. Heat treatment A is recommended for optimum creep and high temperature rupture properties, while heat treatment B is recommended for applications requiring high tensile strength.

Heat treatment A comprises a solution treatment at 1700 to 1850° F. for a time commensurate with the section size, followed by a first air cooling. The first air cooling is followed by a stabilization treatment at 1550° F. for three hours, followed by a second air cooling. Following the second air-cooling is a precipitation treatment at 1325° F. for 8 hours. The object is then cooled in a furnace at a rate of 100° F./hr to 1150° F. where it is held for 8 hours. The cooling in the furnace is followed by a third air cooling.

Heat treatment B comprises a solution treatment at 1700 to 1850° F. for a time commensurate with the section size followed by a first air cooling. The first air cooling is followed by a precipitation treatment at 1325° F. for 8 hours followed by cooling in a furnace at a rate of 100° F./hr to a temperature of 1150° F. where it is held for 8 hours. This is followed by a second air cooling.

In general, heat treatment A is recommended for optimum creep and rupture properties, while heat treatment B is recommended for applications requiring high tensile strength. It is generally desirable for a turbine rotor to display high tensile strength at low and intermediate temperatures (of less than or equal to about 700° F.) in some locations. High tensile strength is generally desirable in parts near the bore and bolt-holes while optimum creep behavior is desirable in other parts such as, for example, near the radially outer end of turbine rotor wheel or disk. However, the radially outer end is generally at higher temperature during operation. If heat treatment A is used, the strength at the bore is not adequate, and if heat treatment B is used, there is not enough creep resistance at the high temperatures. As a result, surface flaws or cracks can propagate rapidly under stress at temperatures above 900° F.

The cracks can occur due to one or more mechanisms. One such mechanism is hold time fatigue cracking. This mechanism generally occurs when the turbine rotor is subjected to extensive operation under high temperatures and high stress at temperatures above 900° F. To prevent such cracking, the turbine rotor has to be frequently visually inspected. This increases down-time as the turbine has to be shut down and dissembled. In addition, the visual inspection may not detect all cracks. This method of crack prevention is generally not suited to power production turbines.

Another method of crack prevention comprises using inlet conditioning schemes to reduce compressor discharge temperature. These inlet conditioning schemes generally use lower turbine temperatures. These lower temperatures however, degrade gas turbine performance.

It is therefore desirable to provide a heat treatment for components manufactured from superalloys such as, for example, Alloy 706 that facilitates an improvement in hold time fatigue crack growth resistance.

BRIEF SUMMARY OF THE INVENTION

Disclosed herein is a method of treating a component comprising solution treating the component for a period of about 4 to about 10 hours at a temperature of about 1750 to about 1850° F.; cooling the component to a temperature of about 1490 to about 1520° F. at an average rate of 1° F./min to about 25° F./min; stabilizing the component at about 1450 to about 1520° F. for a period of from about 1 to about 10 hours; cooling the component to room temperature; precipitation aging the component by heating the component to a first precipitation aging temperature of about 1275 to about 1375° F. for about 3 to about 15 hours; cooling the component at an average rate of 50 to about 150° F./hour to a second precipitation aging temperature of about 1100 to about 1200° F. for a time period of about 2 to about 15 hours; and cooling the component.

BRIEF DESCRIPTION OF THE DRAWINGS

The FIGURE is a cross-section of a typical turbine rotor of the type that is amenable to the heat treatment of this invention.

DETAILED DESCRIPTION OF THE INVENTION

Disclosed herein is a method for heat treatment of a component that improves hold time fatigue crack growth resistance. The component comprises a superalloy. The method comprises several heating and cooling steps one of which comprises heating the component to a stabilization temperature of about 1490 to about 1520° F. for a period of about 1 to about 10 hours. The method advantageously minimizes intergranular corrosion and cracking in components manufactured from superalloys. As a result of the heat treatment prescribed by the method, the superalloy used in the component develops a resistance to intergranular cracking. This resistance is developed because of the precipitation of an eta ($\eta$) phase at the grain boundaries.

As noted above, superalloys are metallic alloys for elevated temperature service that comprise group VIIA elements. Superalloys based on nickel, cobalt or iron may be subjected to the method for heat treatment disclosed herein. Examples of such superalloys are HASTALLOY®, INCONEL®, HAYNES® alloys, MP98T®, TMS alloy, CMSX® single crystal alloys or combination comprising at least one of the foregoing alloys. An exemplary alloy that can be subjected to the heat treatment disclosed herein is Alloy 706. An exemplary component is a turbine rotor that comprises Alloy 706. Alloy 706 used in the turbine rotor develops a resistance to intergranular cracking failure modes.

Alloy 706 generally comprises about 37 to about 45 weight percent (wt %) nickel, about 12 to about 18 wt % chromium, up to about 10 (i.e., 0 to about 10) wt % molybdenum. The Alloy 706 can also comprise manganese, tungsten, niobium, titanium, and aluminum in an amount of about 4 to about 10 wt %, with the balance being iron.

With reference to the FIGURE, a disk component from a turbine rotor 10 is shown in cross-section, and illustrates the complex shape that requires specialized heat treatment. The shape varies from a relatively thick radially inner portion 12 that is radially adjacent the rotor bore, through an intermediate portion 14 of decreasing thickness, to a radially outer portion 16 that is generally thinner than portion 12 but with variations indicated at 18 and 20.

In arriving at the method of heat treatment, the above described geometry of the FIGURE is taken into account, recognizing that the outer portion 16 and surfaces thereof remain at stabilization temperature for a different period than the inner portion 12 near the bore (not shown). The disk may be rapidly cooled from the stabilization temperature before the disk has a chance to achieve a uniform temperature throughout. In other words, the outer portion experiences this stabilization temperature for a longer period than the inner portion because of cross-sectional area differences and slow conduction of heat through the disk during heating to the stabilization temperature.

The method of heat treatment advantageously comprises solution treating the turbine rotor for a time period of about 4 to about 10 hours at a temperature of about 1750 to about 1850° F. Solution treating of the turbine rotor is generally conducted by holding the rotor at an elevated temperature for a sufficient length of time to allow a desired constituent of the Alloy 706 to enter into solid solution, followed by rapid cooling to hold the constituent in solution. However, in this invention, the rotor will be cooled from solution temperature to stabilization temperature at a controlled cooling rate. The rotor is not cooled all the way to room temperature. The purpose is to precipitate specific grain boundary phases rather than hold the constituent in solution. In one embodiment, the time period for the solution treating can be an amount of about 5 to about 8 hours. An exemplary time period for the solution treating is about 8 hours. In another embodiment, the temperature for the solution treating is about 1750 to about 1850° F. An exemplary temperature for the solution treating is about 1800° F.

As noted above, the turbine rotor is then cooled in a stabilization step to a stabilization temperature of about 1450 to about 1520° F. at an average rate of about 1° F. per minute (° F./min) to about 25° F./min. In one embodiment, the stabilization temperature is about 1495 to about 1515° F. An exemplary temperature for the stabilizing is about 1500° F., and an exemplary average rate of cooling is about 10° F./min. A suitable time period for stabilization is about 1 to about 10 hours. In one embodiment, a suitable time period for stabilization is about 2 to about 8 hours. An exemplary time period is about 5 hours.

The turbine rotor is then cooled to room temperature. Room temperature is about 30 to about 100° F. The average rate of cooling from the elevated temperature (i.e., about 1450 to about 1520° F.) to room temperature at a rate of about to about 50° F./min. This cooling is continuously conducted in a furnace in a controlled manner till the rotor reaches a temperature that precipitation hardening is not happening.

The rotor is then precipitation aged in two steps. In a first precipitation aging step the turbine rotor is heated to a temperature of about 1275 to about 1375° F. for about 3 to about 15 hours. In one embodiment, the precipitation aging is conducted at a temperature of about 1290 to about 1375° F. A suitable time period for the precipitation aging is about 5 to about 9 hours. An exemplary precipitation aging can be conducted at 1325° F. for about 8 hours. Precipitation aging, also called "age hardening", is a heat treatment technique used to strengthen malleable materials. It relies on changes in solid solubility with temperature to produce fine particles of a secondary phase, which impede the movement of dislocations, or defects in a crystal's lattice. Since dislocations are often the dominant carriers of plasticity (deformations of a material under stress), this serves to harden the material.

Following the first step of precipitation aging, the turbine rotor is cooled in a furnace at a rate of about 50 to about 150° F./hour to a temperature of about 1100 to about 1200° F. An exemplary cooling rate is 100° F./hour. The annealing at a temperature of about 1100 to about 1200° F. constitutes the second precipitation aging step.

An exemplary temperature for the second precipitation step is about 1150° F. In one embodiment, the turbine rotor is held at a temperature of about 1100 to about 1200° F. for about 2 to about 15 hours. In an exemplary embodiment, the turbine rotor is held at about 1150° F. for a time period of about 8 hours. The turbine rotor is then air cooled to room temperature.

As noted above, treating the turbine rotor according to the aforementioned method results in a reduction in intergranular corrosion and cracking. The heat treatment method described results in the formation of η phases that reduces intergranular corrosion.

The following examples, which are meant to be exemplary, not limiting, illustrate the method of heat treatment of a turbine rotor comprising an Alloy 706 composition as described herein.

EXAMPLE

This example was conducted to demonstrate the effect of the stabilization temperature on the time to failure of a section of a turbine rotor. A portion of the bolt-hole region (hereinafter the "component") of the turbine rotor was subjected to the following heat treatment method. The component was solution heat treated to a temperature of 1775° F. for a time period of 8 hours. Following this, the component was cooled to a temperature of either 1500 or 1550° F. respectively and stabilized at each of these respective temperatures for a time period of either 1, 3 or 5 hours. The cooling rate from the solution heat treatment temperature of 1775° F. to the stabilization temperature of either 1500 or 1550° F. was 5° F./min or 25° F./min. Thus the design of experiments (DOE) in this heat treatment experiment consisted of a total of 8 combinations by 3 variables, each with 2 levels.

Following the stabilization, the component was cooled to room temperature. All the DOE heat treatment samples had a common precipitation aging cycle. The component was precipitation aged at 1325° F. for about 8 hours followed by cooling the component to 1150° F. and retaining the component at 1150° F. for about 8 hours. The sample was then air cooled to room temperature. The test protocol along with the test data is shown in the Table 1.

The heat treatment was conducted in a vacuum furnace to obtain a controlled cooling rate. After heat treatment, all samples were tested to determine the crack propagation resistance of the component. A fatigue pre-crack was created in the individual components. A fatigue pre-crack was created in a compact tension specimen from each of the DOE heat treated components and the specimen was heated to the test or service temperature in ambient laboratory conditions. The growth rate of the fatigue pre-crack was monitored until the test article failed, or until a pre-selected time was reached, in which case the time dependent portion of the crack advance was measured. Depending on whether the test article failed or the pre-selected time was reached, either the time to failure or the degree of crack advance was correlated with static crack growth rates.

The side grooved specimens start with a crack length of 0.160 inch (0.40 centimeter), and were fatigue pre-cracked at frequency of 10 to 20 Hz at room temperature, and at a R ratio of 0.1. The Electric Potential Drop (EPD) method of crack growth measurement was used to measure the crack growth, and the pre-crack was terminated when the EPD reading showed that the crack length reaches 0.210 inch (0.53 centimeter). This yields a stress concentration factor K value of 28 Ksi in (½) under a load of 1099 lb-f (498.5 kg-f).

The test was conducted for a maximum time of 2 weeks (336 hours). If specimens failed in the 2 weeks testing period, actual failure time will be recorded. If specimen did not fail, tests were terminated when the test time reached 336 hours. Specimens were broken apart and crack length was measured. The life prediction method of un-failed specimens was based on methodology developed at the GE Global Research Center, in which information about measured crack length growth is based upon the final potential drop net ratio, and net ratio at 15 minutes of testing.

TABLE 1

| Sample # | Cooling Rate (° F./min) | Stabilization Temp (° F.) | Stabilization Time (min) | Time to Failure (hr) |
|---|---|---|---|---|
| 1 | 5 | 1500 | 60 | 78.7 |
| 2 | 25 | 1500 | 60 | 93.3 |
| 3 | 5 | 1500 | 180 | 1,442.0 |
| 4 | 25 | 1500 | 180 | 1,233.0 |
| 5 | 5 | 1500 | 300 | 1,294.5 |
| 6 | 25 | 1500 | 300 | 65,801.6 |
| 7 | 5 | 1500 | 60 | 132.5 |
| 8 | 25 | 1550 | 60 | 21.8 |
| 9 | 5 | 1550 | 180 | 960.4 |
| 10 | 25 | 1550 | 180 | 54.0 |
| 11 | 5 | 1550 | 300 | 212.7 |
| 12 | 25 | 1550 | 300 | 126.5 |
| Base | | | | 8.0 |

From the Table 1 it may be seen that by maintaining the component at the stabilization temperature of 1500 to 1550° F. for a time period of 1 to 5 hours, the time to failure is increased. The comparative sample titled "Base" in the Table 1 shows a time to failure of only 8 hours, whereas the samples heat treated at 1500° F. display a time to failure of about 78 to about 65,801 hours.

From the aforementioned tests, it may be seen that the heat treated components from the turbine rotor can withstand a stress intensity factor of 28 Ksi-in½ for a time period of about 100 to about 65,000 hours, specifically about 200 to about 60,000 hours, more specifically about 500 to about 50,000 hours and even more specifically about 10,000 to about 40,000 hours.

Thus, by heat treating articles such as turbine rotors that comprise Alloy 706 according to the method prescribed above, it is possible to increase the time for sustained load crack growth failure by an amount of greater than or equal to about 100%, specifically greater than or equal to about 200%, more specifically greater than or equal to about 400%, even more specifically greater than or equal to about 1,000%.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of treating a superalloy component, comprising:

solution treating the component for a period of about 4 to about 10 hours at a temperature of about 1750 to about 1850° F.;

cooling the component to a stabilizing temperature of about 1450° F. to about 1520° F. at an average rate of 1° F./min to about 25° F./min;

stabilizing the component at about 1450° F. to about 1520° F. for a period of from about 1 to about 3 hours;

cooling the component from the stabilizing temperature to room temperature;

precipitation aging the component by heating the component to a first precipitation aging temperature of about 1275° F. to about 1375° F. for about 3 to about 15 hours;

cooling the component at an average rate of 50° F./hour to about 150° F./hour to a second precipitation aging temperature of about 1100° F. to about 1200° F. for a time period of about 2 to about 15 hours; and cooling the component from the second precipitation aging temperature.

2. The method of claim 1, wherein the component is solution treated to a temperature of about 1775° F.

3. The method of claim 2, wherein the component is solution treated for about 8 hours.

4. The method of claim 1, wherein the stabilizing the component is conducted at a temperature of 1500° F.

5. The method of claim 1, wherein a precipitation aging is conducted at the first precipitation aging temperature of about 1325° F.

6. The method of claim 5, wherein a precipitation aging at the first precipitation aging temperature is conducted for about 5 to about 9 hours.

7. The method of claim 1, wherein a precipitation ageing is conducted at the second precipitation aging temperature of about 1150° F.

8. The method of claim 1, wherein a precipitation aging at the second precipitation aging temperature is conducted for about 5 to about 9 hours.

9. The method of claim 1, wherein the component is a turbine rotor.

10. The method of claim 1, wherein the component comprises a nickel-iron base superalloy.

11. The method of claim 10, wherein the nickel-iron base superalloy comprises, by weight: about 37 to about 45% nickel, about 12 to about 18% chromium, up to about 10% molybdenum and the balance iron.

12. The method of claim 11, wherein the nickel-iron base superalloy further comprises manganese, tungsten, niobium, titanium and aluminum.

13. The method of claim 12, wherein the manganese, tungsten, niobium, titanium and aluminum comprise, in weight percent, about 4 to about 10% of the superalloy.

* * * * *

UNITED STATES PATENT AND TRADEMARK OFFICE

CERTIFICATE OF CORRECTION

PATENT NO. : 8,668,790 B2
APPLICATION NO. : 11/620884
DATED : March 11, 2014
INVENTOR(S) : Ling Yang et al.

It is certified that error appears in the above-identified patent and that said Letters Patent is hereby corrected as shown below:

In the Specification

In column 3, line 1, delete "HASTALLOY®," and insert -- HASTELLOY®, --, therefor.

In column 4, line 1, before "to" insert -- 5 --.

Signed and Sealed this
Fourteenth Day of April, 2015

Michelle K. Lee

Michelle K. Lee
*Director of the United States Patent and Trademark Office*